US010040302B2

(12) United States Patent
Nakamura et al.

(10) Patent No.: US 10,040,302 B2
(45) Date of Patent: Aug. 7, 2018

(54) PRINTER AND TRANSPORT APPARATUS FOR TRANSPORTING PRINT MEDIUM WHILE APPLYING STABLE TENSION TO THE PRNT MEDIUM

(71) Applicant: MIMAKI ENGINEERING CO., LTD., Nagano (JP)

(72) Inventors: Kohei Nakamura, Nagano (JP); Kazutaka Tamaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/598,318

(22) Filed: May 18, 2017

(65) Prior Publication Data

US 2017/0341436 A1 Nov. 30, 2017

(30) Foreign Application Priority Data

May 27, 2016 (JP) ..... 2016-106677

(51) Int. Cl.
*B41J 15/16* (2006.01)
*B65H 23/188* (2006.01)

(52) U.S. Cl.
CPC ..... *B41J 15/16* (2013.01); *B65H 23/188* (2013.01)

(58) Field of Classification Search
CPC ..... B41J 15/16; B41J 15/04; B41J 13/0009; B41J 15/046; B41J 11/0005; B41J 11/001; B41J 11/04; B65H 23/188
See application file for complete search history.

(56) References Cited

U.S. PATENT DOCUMENTS 6,285,854 B1 * 9/2001 Obata ..... B41J 15/005 399/384
2011/0279867 A1 * 11/2011 Okura ..... B41J 15/165 358/1.15

FOREIGN PATENT DOCUMENTS

JP 5334986 11/2013

* cited by examiner

*Primary Examiner* — Henok Legesse
(74) *Attorney, Agent, or Firm* — JCIPRNET

(57) ABSTRACT

A pinion gear is coaxially attached to vicinity of an end of an inner bar. The pinion gear is engaged with a rack gear and rotates in response to upward and downward movements of the tension bar. When the pinion rotates, the inner bar correspondingly rotates. The inner bar and an outer bar, which is a tension applying bar, are connected to each other so as to freely rotate. When the pinion rotates, the inner bar correspondingly rotates, while the outer bar remains unrotated.

5 Claims, 17 Drawing Sheets

PRINTER AND TRANSPORT APPARATUS FOR TRANSPORTING PRINT MEDIUM WHILE APPLYING STABLE TENSION TO THE PRNT MEDIUM

CROSS REFERENCE TO RELATED APPLICATIONS

This application claims the priority benefit of Japanese Patent Application No. 2016-106677, filed on May 27, 2016. The entirety of the above-mentioned patent application is hereby incorporated by reference herein and made a part of this specification.

TECHNICAL FIELD

This disclosure relates to a printer and a transport apparatus, more particularly to a printer and a transport apparatus configured to transport a print medium while applying a stable tension to the print medium using a tension bar.

DESCRIPTION OF THE BACKGROUND ART

Among the known printers are printers that carry out printing on a print medium in the form of a long sheet unwound from a feed roller and have a take-up roller collect the printing-completed medium. The printers of this type are equipped with a transport mechanism. The transport mechanism transports the print medium held on the upstream side, in the transport direction of the print medium, relative to a printing unit in charge of carrying out printing on the print medium. Such printers may further have a tension applying mechanism between the feed roller or the take-up roller and the printing unit. The tension applying member applies a predetermined tension to the print medium so as to unwind or take up the print medium without creasing or slackening it. The tension to be applied then may differ depending on a print medium selected and used, a printing speed, and contents to be printed on the medium. To deal with this, a tension applying mechanism was proposed. The tension applying mechanism includes a tension bar 1001 structured as illustrated in FIG. 10, and a counterweight 1002 on a side facing an oscillatory rotation shaft 1003. This mechanism is operable to change a tension to be applied by adjusting the weight of the counterweight 1002.

The tension applying mechanism thus structured needs a space for movement of the counterweight 1002 and an arm 1004 supporting the tension bar, in addition to a space for movements of the tension bar. This may be a bottleneck in the pursuit of space saving. In the meantime, a linear tension applying mechanisms requiring no oscillatory rotation shaft was proposed, as described in Japanese Patent No. 5334986. To keep the tension bar horizontally, the tension applying mechanism structured as described in Japanese Patent No. 5334986 has pinions at both ends of the tension bar and a rack on one side of the tension bar closer to a support unit. The pinions and the rack are engaged with each other so as to keep a balance between the two ends. This known tension applying mechanism, in order to apply a bias to a print medium, uses the self weight of the tension bar and weights hanging with ropes from the ends of the tension bar.

SUMMARY

In the tension applying member structured as described in Japanese Patent No. 5334986, however, the tension bar, when moving up and down, is rotated by the movements of the pinions and the rack. This rotation of the tension bar may transmit to the print medium, compromising stability in the transport of the print medium. This tension applying member with weights hanging with ropes from the ends of the tension bar involves the risk of the weights being displaced or falling off from the tension bar due to the rotation of the tension bar. Thus, using plural weights may encumber the rotation or movement of the tension bar.

The tension applying member described in Japanese Patent No. 5334986 has a sensor that detects the position of the tension bar. The sensor, however, is only responsive to the downward movement of the tension bar as far as a predetermined position. This sensor can only detect the arrival of the tension bar at the given lowest position, while failing to detect other positions within an allowable moving range of the tension bar. In this tension applying mechanism, using the sensor alone may be inadequate for accurate control of the tension to be applied to the print medium. It may be accordingly difficult to apply a stable tension to the print medium.

To address these issues, this disclosure provides a printer and a transport apparatus characterized in that a tension applying member includes a tension applying bar and a pinion bar on an inner side of the tension applying bar. The pinion bar is a shaft parallel to a direction in which the tension applying bar is extending. The pinion bar supports the tension applying bar so as to allow for relative rotation and has a pinion at an end of the pinion bar. These structural features may prevent the rotation of the tension applying bar from transmitting to a print medium, thereby affording stability in the transport of the print medium. This disclosure also provides a printer and a transport apparatus in which the pinion bar is equipped with a member that holds a weight for adjustment of the tension of the tension applying member. These structural features may prevent possible displacement or fall-off of the weight due to the rotation of the tension applying bar, avoiding interference with the movement or rotation of the tension applying bar. This disclosure further provides a printer and a transport apparatus including, as sensors for position detection of the tension applying bar, an optical sensor that detects an absolute position and a linear encoder that measures a relative position. These structural features may ensure accurate tension control, allowing a stable tension to be applied.

To address the described issues, a first aspect of this disclosure relates to a printer configured to carry out printing on a medium unwound from a feed roller and collect the medium using a take-up roller. The printer includes the following: a transport unit disposed on a transport path between the feed roller and the take-up roller; a tension applying member disposed on the transport path between the feed roller and the take-up roller and including a tension applying bar having a tubular shape and a pinion bar; and a support unit having a guiding unit that guides the tension applying member in a moving direction of the tension applying member and further having a rack engageable with the pinion of the pinion bar to allow for movement of the tension applying member while the pinion bar is rotating. The transport unit transports the medium in a predetermined transport direction. The tension applying bar extends in a direction intersecting with the transport direction of the medium and applies a tension to the medium by coming in contact with the medium. The pinion bar is a shaft disposed inside of the tubular shape of the tension applying bar and parallel to a direction in which the tension applying bar is extending. The pinion bar supports the tension applying bar so as to allow for relative rotation and has a pinion at an end of the pinion bar in the direction in which the tension applying bar is extending. The tension applying member applies a certain degree of tension to the medium by moving the guiding unit. These structural features may prevent the rotation of the tension applying bar from transmitting to a print medium, thereby affording stability in the transport of the print medium.

A second aspect of this disclosure relates to the printer according to the first aspect, further characterized in that the pinion bar includes a weight holder that holds a weight for adjustment of the tension applied by the tension applying member. Using the weight holder may allow the weight to be mounted so that the print medium in contact with the tension applying bar will not be affected by unwanted tension. This may enable flexible tension adjustments for various types of print media.

A third aspect of this disclosure relates to the printer according to the first or second aspect, further characterized in that the weight holder is disposed at both ends of the pinion bar, the weight is a hollow column or a hollow disc coaxial with the pinion bar, and a hollow portion of the hollow column or the hollow disc is greater in diameter than the tension applying bar. The tension applying bar may be rotatable independently from the weight having a greater moment than the tension applying bar. This may prevent the print medium from being affected by unwanted tension.

A fourth aspect of this disclosure relates to the printer according to any one of the first to third aspects, further characterized in that the support unit has a tension applying member fixture in an upper part of the support unit. This may avoid any damage to the print medium when the print medium is replaced with another medium.

A fifth aspect of this disclosure relates to a transport apparatus configured to take up a medium unwound from a feed roller using a take-up roller. The transport apparatus includes the following: a transport unit that transports the medium in a predetermined transport direction; a tension applying member having pinions at its both ends and disposed between the feed roller or the take-up roller and the transport unit, the tension applying member applying a tension to the medium by coming in contact with the medium; a support unit that supports the tension applying member, the support unit having a rack engageable with the pinion of the pinion bar; a position detector having a detection head that moves with the tension applying member, the detection head having a driven-to-move plate to define a moving range of the tension applying member, and a linear scale with a scale read by the detection head; and a moving range determining unit which has two sensors that detect the presence/absence of the driven-to-move plate and which detects whether the tension applying member is within the moving range based on patterns detected by the two sensors. The transport unit thus characterized may accurately detect the position of the tension applying member and ensure accurate tension control, allowing a stable tension to be applied.

The printer and the transport apparatus disclosed herein are characterized by the following structural and technical features. The tension applying member has the tubular tension applying bar disposed on the transport path between the feed roller and the take-up roller, extending in a direction intersecting with the transport direction of the medium, and configured to apply a tension to the medium by coming in contact with the medium. The tension applying member further has the pinion bar being a shaft disposed inside of the tubular shape of the tension applying bar and parallel to the direction in which the tension applying bar is extending. The pinion bar supports the tension applying bar so as to allow for relative rotation and has a pinion at an end of the pinion bar in the direction in which the tension applying bar is extending. The support unit has the guiding unit and the rack. The guiding unit guides the tension applying member to move in the moving direction of the tension applying member, and the rack is engageable with the pinion of the pinion bar to allow the tension applying member to move while the pinion bar is rotating. The tension applying member applies a certain degree of tension to the medium by moving the guiding unit. The printer and the transport apparatus thus characterized may prevent the rotation of the tension applying bar from transmitting to the print medium, thereby affording stability in the transport of the print medium.

Further provided are the position detector having the detection head that has the driven-to-move plate to define the moving range of the tension applying member and moves with the tension applying member, and the linear scale with a scale read by the detection head; and the moving range determining unit which has two sensors that detect the presence/absence of the driven-to-move plate and which detects whether the tension applying member is within the moving range based on patterns detected by the two sensors. The printer and the transport apparatus thus characterized may ensure accurate tension control, allowing a stable tension to be applied.

DETAILED DESCRIPTION OF EMBODIMENTS

Hereinafter, embodiments of the printer and the transport apparatus disclosed herein are described referring to the accompanying drawings.

First Embodiment

Figure 1:
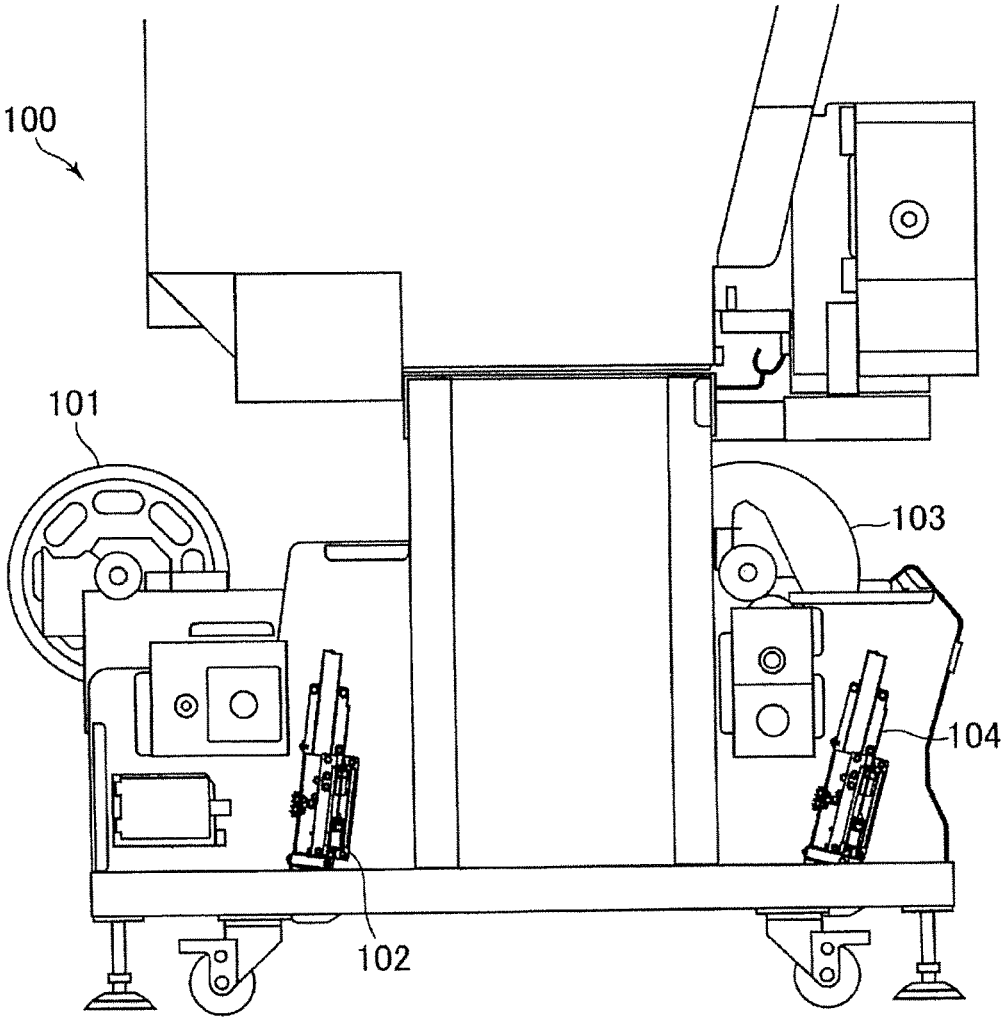
FIG. 1 is a drawing of an external view of a printer according to an embodiment of this disclosure.
Figure 2:
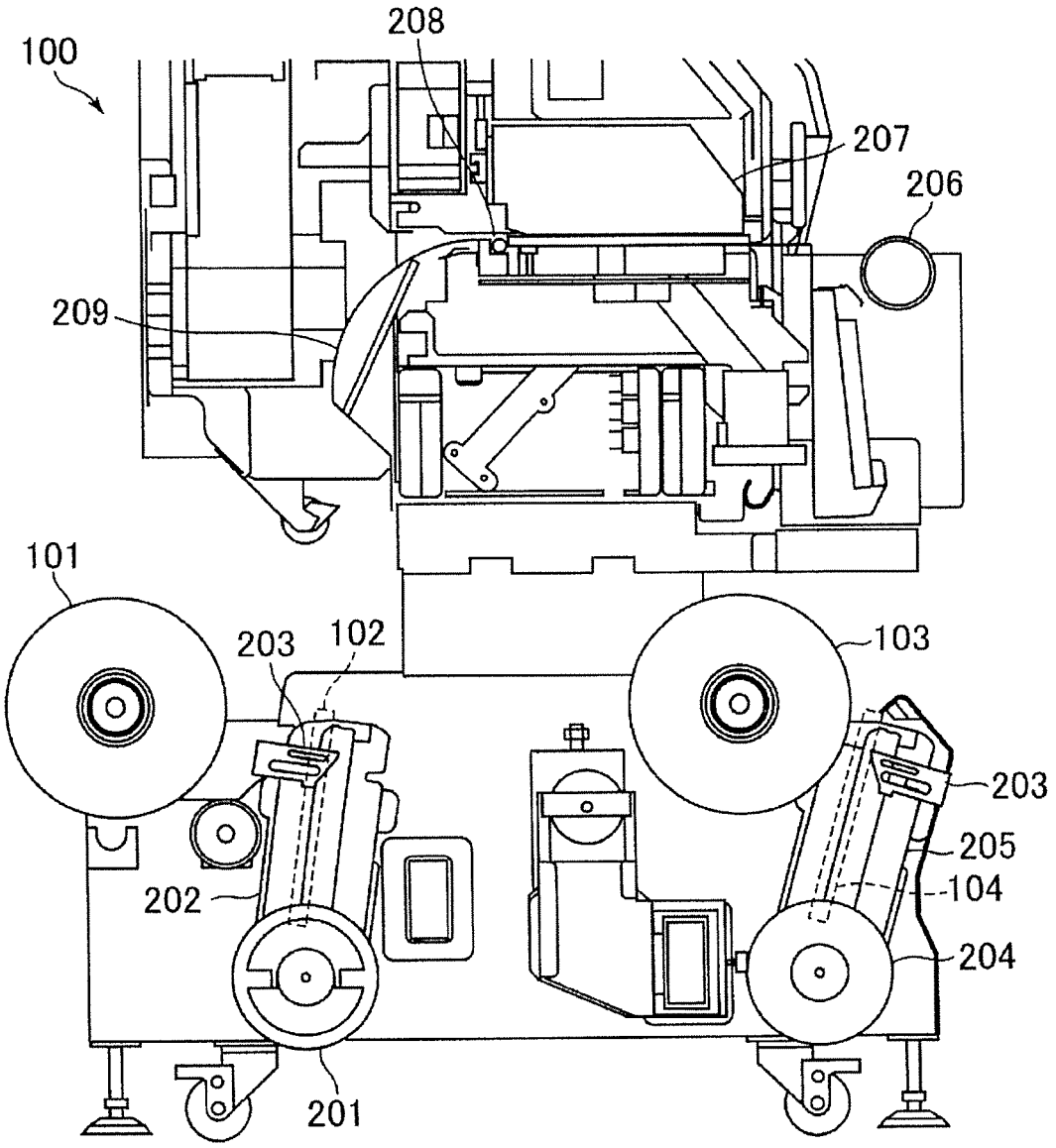
FIG. 2 is a drawing of an internal configuration of the printer according to the embodiment.

FIG. 1 is an external view of a printer 100 according to a first embodiment of this disclosure when the printer 100 is viewed in a lateral direction perpendicular to a print medium transport direction. The print medium is unwound from a feed roller 101 and transported, from left to right facing FIG. 1, to a take-up roller 103. A sensor unit 102 on the medium-feeding side and a sensor unit 104 on the take-up side are disposed at outer ends on one side of tension bars 201 and 204 disposed, as illustrated in FIG. 2, in parallel to each other on a depth side of this figure to detect positions of the tension bars 201 and 204. The sensor units 102 and 104, which are disposed at outer ends on one side of the tension bars 201 and 204 in this description, may instead be disposed at outer ends on both sides to improve the accuracy of detection.

FIG. 2 is a side view of the printer from which the sensor units 102 and 104 in FIG. 1 and part of a cabinet have been removed. The tension bar 201 on the medium-feeding side is disposed between the feed roller 101 and a platen 209 on the transport path. The tension bar 204 on the take-up side is disposed between the take-up roller 103 and a pull roller 206. The tension bars 201 and 204 are respectively supported by guide rails 202 and 205. The tension bars 201 and 204, by moving upward or downward along these guide rails, apply a stable tension to the print medium. The sensor units 102 and 104 are disposed at outer ends on both sides of the guide rails as indicated with dotted lines to detect positions of the tension bars on the guide rails.

The printer further has tension bar fixtures 203 in upper parts of the guide rails 202 and 205. During the replacement of a roll of print medium, these fixtures are used to fix the tension bars at upper positions so as to facilitate the roll replacement. The tension bars of printers manufactured these days are structured to move as far as positions near a floor surface. In cases where the tension bars are still at relatively low positions at the time of replacing the roll of print medium, the print medium may partly contact the floor, which may damage the medium. To avoid that, this embodiment fixes the tension bars at as high positions as possible, thereby avoiding possible damage to the print medium during the replacement.

The tension bar has pinions attached to its both ends. These pinions are engaged with racks of the guide rails 202 and 205. By disposing the tension bar fixtures 203 at ends on one side of the tension bars, therefore, ends on the other side of the tension bars, with no tension bar fixture 203, may be fixed by the rack-pinion engaging mechanisms. The tension bar has the rack-pinion engaging mechanisms at its both ends. In cases where a force acts on the tension bar through the print medium, these mechanisms may help to keep the both ends of the tension bar at the same positions in height. The racks may be engaged at optional positions with the pinions attached to the both ends of the tension bars. The racks, instead of being attached to the guide rails 202 and 205, may be disposed at other positions, for example, in the body of the printer 100.

Figure 11:
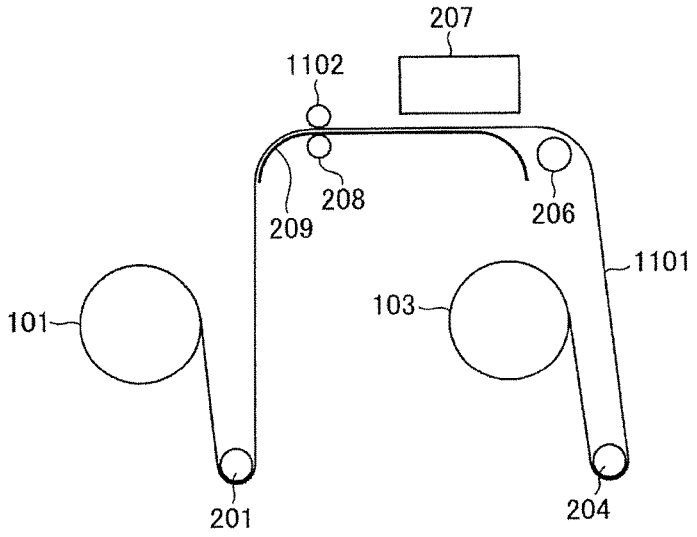
FIG. 11 is a schematic drawing of a relationship among a print medium, a roller, a printing unit, and the tension bar according to the embodiment.
Figure 17:
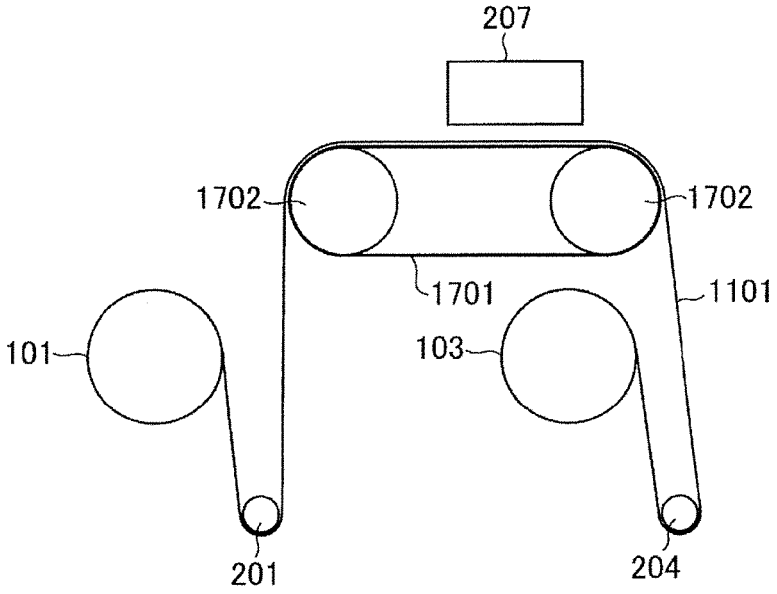
FIG. 17 is a schematic drawing of a relationship among a print medium, a roller, a printing unit, and the tension bar according to the another embodiment.

FIG. 11 is a conceptual view of the transport of the print medium. Referring to FIG. 11, a print medium 1101 is unwound from the feed roller 101 and transported in contact with the tension bar 201 and carried onto the platen 209. Then, the print medium 1101 is transported between a pinch roller 1102 and a grid roller 208, and printing is carried out under a carriage 207. The pinch roller 1102 and the grid roller 208 vertically face each other and vertically hold therebetween the print medium 1101. The transport direction of the print medium 1101 on the platen 209 is a direction from the left to right on the drawing of FIG. 11. The printing-completed print medium 1101 travels along the pull roller 206 and the tension bar 204, and is finally collected by the take-up roller 103. In this embodiment, the print medium 1101 is transported while being held between the pinch roller 1102 and the grid roller 208. Instead, the print medium 1101 may be transported by a transport belt 1701, as illustrated in FIG. 17. Though the transport belt 1701 is driven by two rollers 1702 in FIG. 17, the number of the rollers that drive the transport belt 1701 may be optionally decided.

With reference to FIG. 11, the print medium 1101 is pulled by the pull roller 206 in the transport direction to apply a tension to the print medium traveling between the pinch roller 1102/grid roller 208 and the pull roller 206. The pull roller 206, however, may be unnecessary depending on the type of the print medium 1101 used.

The carriage 207 holding a printer head is movably supported by a guide rail not illustrated in the drawing, and moves in a main scanning direction orthogonal to the transport direction of the print medium 1101 on the platen 209. In FIG. 11, the main scanning direction is a direction from the front to back on the drawing or a direction opposite thereto. In this embodiment, the printer head is disposed on the lower surface of the carriage 207 away by a predetermined gap from the print medium 1101. The printer head has nozzle arrays each having multiple nozzles through which minute ink droplets are discharged. The nozzles in each nozzle array are linearly arranged in the transport direction of the print medium 1101. The printer head may have an optional number of nozzle arrays. The nozzle arrays may be arranged in the main scanning direction.

The print medium 1101 is transported on the platen 209 by the pinch roller 1102, grid roller 208, and pull roller 206. With the print medium being progressively unwound from the feed roller as the printing operation advances, the roll becomes smaller in diameter. This may change the approach of the print medium 1101 with respect to the tension bar 201 and an angle of the approach, failing to apply a stable tension. For that reason, the tension bar 201 moves upward and downward along the guide rails 202 so as to apply a stable tension to the print medium 1101. This action takes place on the take-up side as well.

In cases where the print medium 1101 is made of a cloth or soft polyvinyl chloride, even higher accuracy is required of the tension to be applied. To subject the print medium to an accurate and stable tension, it is necessary to control the approach of the print medium 1101 with respect to the tension bars 201 and 204 and angles of the approach. This necessitates accurate detection of the tension bars' positions.

Conventionally, the position of a tension bar may be controlled based on its upper-limit or lower-limit position alone. Such a method that solely relies on the upper- or lower-limit detection to control the tension bar may induce instantaneous movement of the tension bar, inviting the risk of a print quality being affected by resulting changes of the tension applied to the print medium 1101. In this respect, this embodiment provides, in addition to the upper-limit and lower-limit sensors, a position sensor using a linear encoder for accuracy in position detection.

Also, any unwanted tension resulting from the rotations of the tension bars needs to be blocked from affecting the print medium. Specifically, in cases of an apparatus in which the tension bar is horizontally balanced by the rack-pinion engaging mechanisms as described later in this embodiment, the pinions at both ends of the tension bar may invite the tension bar to rotate in all of up and down movements. The direction in which the tension bar rotates may differ depending on whether the movement is upward or downward. Nevertheless, unwanted tension is eventually applied to the print medium. To avoid that, this embodiment provides dual-structured tension bars, which will be described later.

In this embodiment, in order to apply an adequate tension to the print medium, the weights are used in combination with the self weights of the tension bars and mounted so as to block any unwanted tension from affecting the print medium in contact with the tension bars as described later.

The sensor units, tension bars, and weights according to this embodiment are hereinafter described. Any suitable method known to the skilled in the art may be employed to control transport mechanisms such as rollers using the sensor units, tension bars, and weights, keep the tension bars at right positions by selecting appropriate weights, and apply an exact tension to the print medium.

In an example of the known methods, the amount of slackness of the print medium 1101 between the feed roller 101 and the pull roller 206 may be changed by driving a stepping motor or the like based on the outer diameter of the feed roller 101 and the direction of rotation of the feed roller 101 feeding the print medium, so that the relative position of the tension bar 201 to the feed roller 101 coincides with a predetermined position. This is a non-limiting example, and any other suitable known method may be employed instead.

[Sensor Unit According to this Embodiment]

Figure 3:
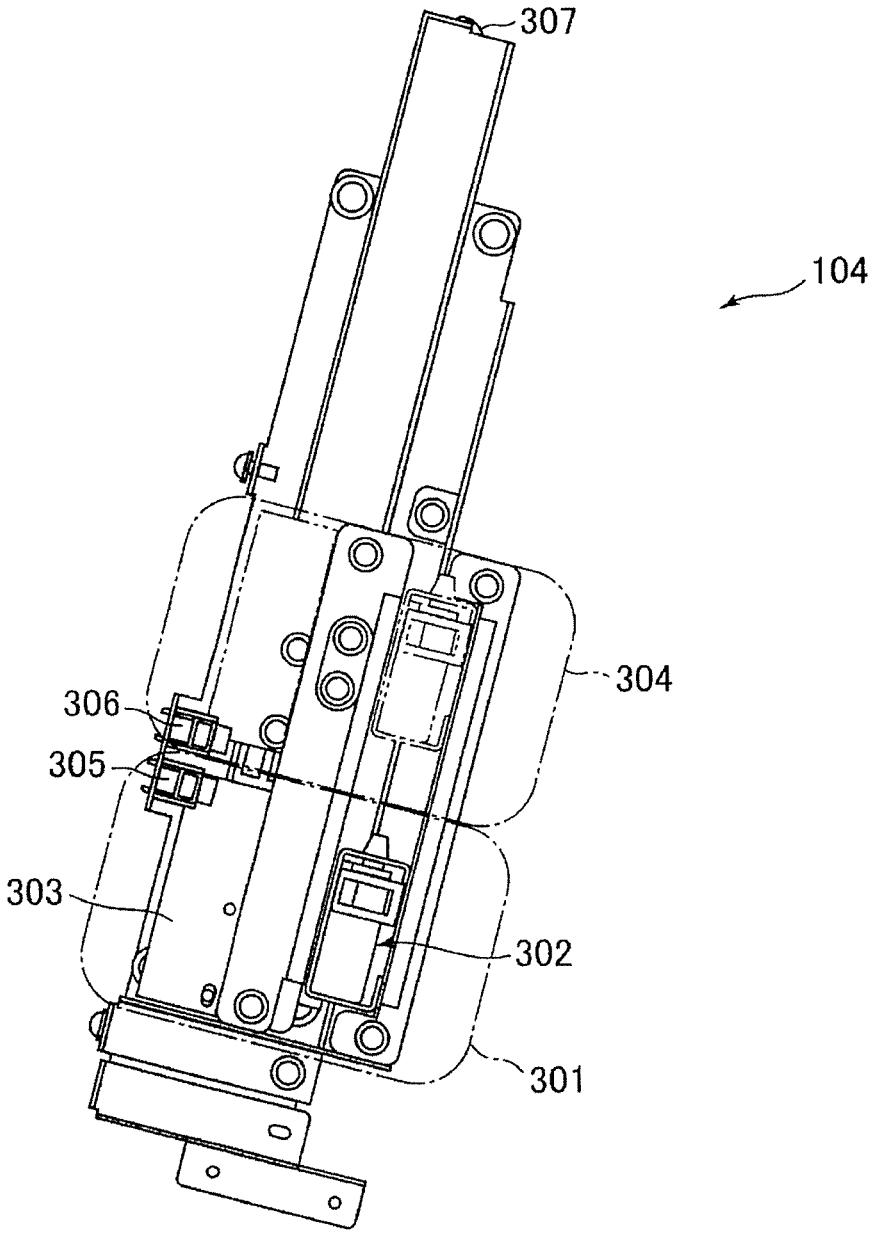
FIG. 3 is an overall structural drawing of a sensor unit of the printer according to the embodiment.

FIG. 3 is a drawing of the sensor unit 104 according to the embodiment. Since the identically configured sensor units are disposed near the tension bars 201 and 204 respectively on the feeding and take-up sides, a description that follows focuses on the sensor unit 104 that detects the position of the tension bar 204.

The sensor unit 104 has a sensor head 302, a driven-to-move plate 303 attached to the lower side of the sensor head 302, and optical sensors 305 and 306 that detect the position of the driven-to-move plate 303. The sensor head 302 moves upward and downward along a guide rail described later, and the driven-to-move plate 303 moves upward and downward as the sensor head 302 moves.

The optical sensors 305 and 306 each have, in an interval extending in the front-to-back direction in FIG. 3, light-emitting elements and light-receiving elements that are respectively paired with and opposite to each other. While the driven-to-move plate is staying in the interval, light is blocked, with no signal outputted from the light-receiving elements. This condition is referred to as "ON" indicating the presence of the driven-to-move plate. Without the driven-to-move plate being present in the interval between the optical sensors 305 and 306, the light-receiving element receives light emitted from the light-emitting element, in response to which a signal is outputted. This condition is referred to as "OFF", indicating the absence of the driven-to-move plate. As described later, an absolute position is determined based on an ON/OFF pattern of outputs from the two optical sensors of the sensor head.

The moving range of the sensor head 302 during the normal printing operation is defined between a lower limit of movement 301 and an upper limit of movement 304. As illustrated in FIG. 3, the condition of the driven-to-move plate 303 within the lower limit of movement is ON for the optical sensor 305 alone but is OFF for the optical sensor 306. The condition of the driven-to-move plate 303 beyond the lower limit of movement is OFF for both of the optical sensors. The condition of the driven-to-move plate 303 within the upper limit of movement is OFF for the optical sensor 305 alone but is ON for the optical sensor 306. The condition of the driven-to-move plate 303 beyond the upper limit of movement is OFF for both of the optical sensors.

Conventionally, the printing operation may be possible by applying a tension within a range of upper and lower limits previously defined for position control of the tension bars. Since the print medium according to this embodiment needs more accurate control as described earlier, the position of the sensor head is measured by a linear scale and used in addition to results of position detection by the optical sensors so as to more accurately detect the tension bar's position. Needless to say, the printer according to this embodiment, under certain circumstances, may be allowed to apply a tension by simply controlling upper and lower limits alone for position control of the tension bars.

Figure 4:
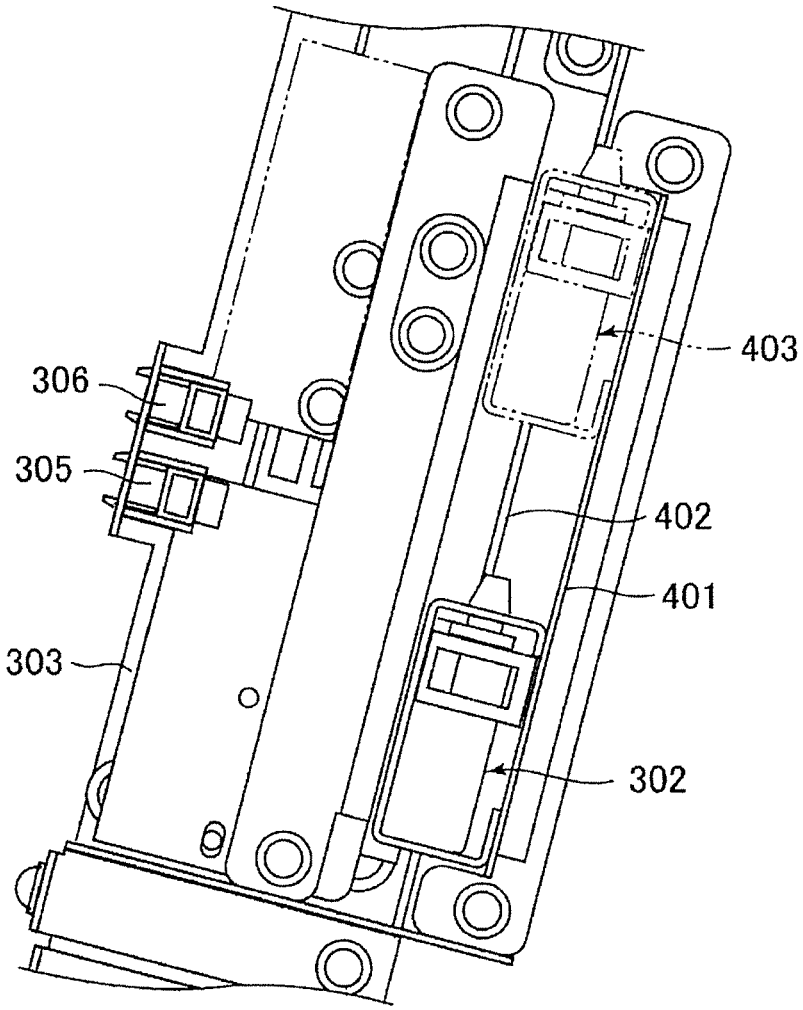
FIG. 4 is a drawing of an exemplified linear encoder of the sensor unit according to the embodiment.

FIG. 4 is a more detailed drawing of the sensor unit according to this embodiment. As described earlier, the sensor head 302 moves upward and downward along a guide rail 402. The normal printing operation is carried out by the time when the sensor head 302 arrives at an upper limit 403. The relative position of the sensor head 302 is measured by having the sensor head 302 read a linear scale 401. This embodiment may use any linear encoder with a linear scale known to the skilled in the art, either optical or magnetic, depending on technical features set forth in this embodiment.

Figure 5:
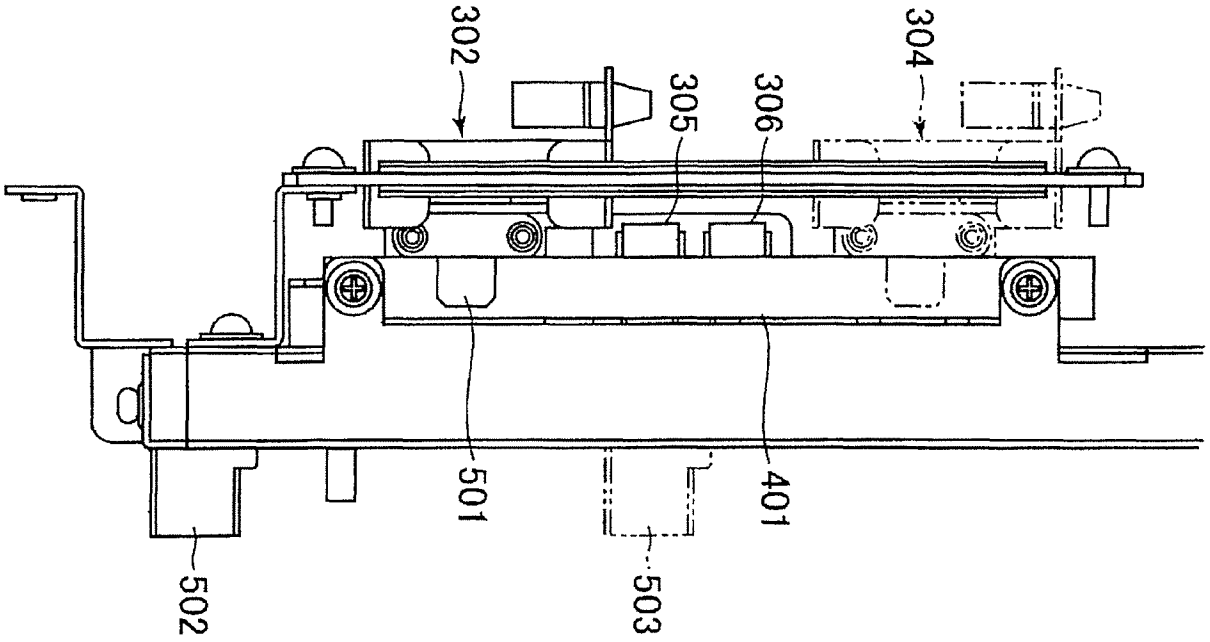
FIG. 5 is a sectional view of the sensor unit according to the embodiment.
Figure 6:
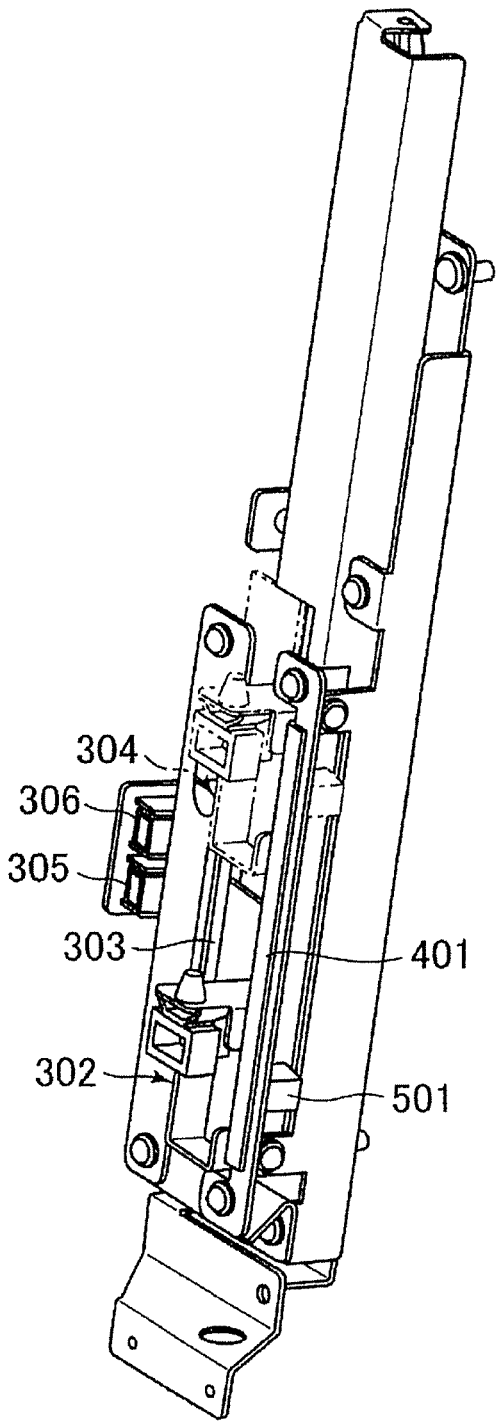
FIG. 6 is a perspective view of the whole sensor unit according to the embodiment.
Figure 7:
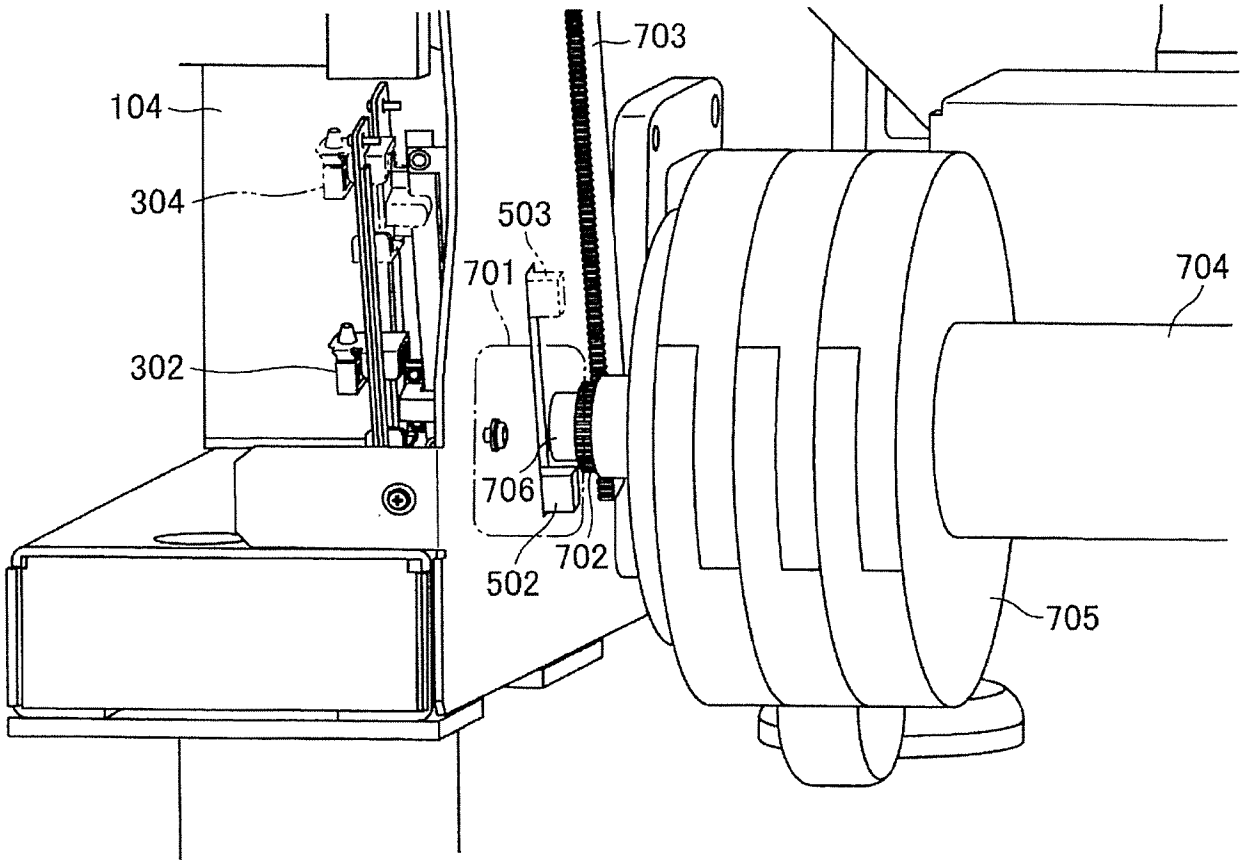
FIG. 7 is an enlarged view of the sensor unit and the pinion of a tension bar according to the embodiment.

A relative position measuring method using a linear encoder is described below with reference to FIGS. 5 to 7. FIG. 5 is a sectional view of the sensor unit. FIG. 6 is a perspective view of the sensor unit. FIG. 7 is an enlarged view of the sensor unit and the pinion of the tension bar according to this embodiment. FIGS. 5 and 7 illustrate a claw 502 that moves with the tension bar 201, 204 to obtain its position. The claw 502 is attached to the sensor head 302. When the claw 502 moves as the tension bar moves, the sensor head 302 correspondingly moves. Based on upper-limit or lower-limit position read by the optical sensor described later, a real position is calculated from a relative value read on the linear scale.

The sensor unit 104 according to this embodiment is set in position so that the guide rail is parallel to the guide rails 202, 205 of the tension bar 201, 204. This sensor unit is located by fitting the claw 502 into an end 706 of the tension bar 201, 204. With reference to FIG. 7, the claw 502 is in contact with the lower side of the end 706 of the tension bar. When the tension bar moves upward, the claw 502, which is pulled upward by a spring or the like not illustrated in the drawing, follows the tension bar, moving upward. It is not particularly necessary for the guide rail of the sensor unit 104 to be parallel to the guide rails 202, 205 of the tension bar 201, 204. For example, an angle made by the horizontal plane and the direction in which the guide rail of the sensor unit 104 is extending may be smaller than an angle made by the horizontal plane and the direction in which the guide rail of the tension bar is extending. By thus having the guide rail of the sensor unit 104 and the guide rail of the tension bar arranged through an angle, the amount of movement of the tension bar may be reduced relative to a predetermined amount of movement of the claw 502. This arrangement may increase the amount of movement of the sensor head 302 when the tension bar vertically moves by a unit length, as compared with arranging the guide rail of the sensor unit 104 in parallel to the guide rail of the tension bar, thereby improving the sensitivity (accuracy of detection) of the sensor unit 104.

The angle made by the horizontal plane and the direction in which the guide rail of the sensor unit 104 is extending may be greater than the angle made by the horizontal plane and the direction in which the guide rail of the tension bar is extending. This arrangement may decrease the amount of movement of the sensor head 302 when the tension bar vertically moves by a unit length, as compared with arranging the guide rail of the sensor unit 104 in parallel to the guide rail of the tension bar, allowing for downsizing of the sensor unit 104.

With the claw 502 being attached to the sensor head 302 as described earlier, the sensor head 302 moves, following the movement of the tension bar. By detecting and measuring absolute and relative positions of the sensor head, the position of the tension bar may be accurately detected. This embodiment may obtain exact positions of the tension bars, thereby controlling the tension bars in a fine-tuned manner as compared with the conventional upper/lower limit-based control. Accordingly, any changes in position of the tension bars may be prevented from affecting a print result.

With reference to FIGS. 6 and 7, a relative position on the linear scale 401 is measured by using this linear scale and a reader head 501 attached to the sensor head 302. When the sensor head 302 moves on the guide rail 402, the reader head 501 attached to the sensor head 302 correspondingly moves along the linear scale 401 disposed in parallel to the guide rail 402. The reader head 501, during the movement, reads a value on the linear scale 401 and transmits a measured result to a controller not illustrated in the drawing at certain time intervals or for each value change, so that the relative position of the tension bar is obtained.

[Tension Bar According to this Embodiment]

As described earlier, the conventional tension bar has pinions at its both ends and is horizontally balanced by the rack-pinion engaging mechanisms. The pinions at both ends of the tension bar, however, may cause the tension bar to rotate every time the tension bar moves upward or downward. To avoid that, the tension bars according to this embodiment each have a dual structure constructed of an inner bar having pinions at both ends of the inner bar and an outer bar in contact with the print medium.

The term "tension bar" used in this embodiment represents a bar-shaped member having such a dual structure, and should be understood as a synonym for the tension applying member or tension applying mechanism. In this disclosure, a pinion gear-equipped component on the inner side of the dually structured bar-shaped component may be referred to as inner bar, or as a pinion bar, because of its function to horizontally stabilize the tension bar using pinions.

A component on the outer side may be referred to as an outer bar, or as a tension applying bar, because of its function to apply a tension by coming in contact with the print medium. In this embodiment, the tension applying member has the tension applying bar and the pinion bar, thereby preventing the rotation of the pinion bar from affecting the print medium. This effect may be even greater when the direction of rotation of the pinion bar moving upward or downward is opposite to the transport direction of the print medium. In the dual structure described herein, the pinion bar and the tension applying bar coaxially rotate. Instead, these bars may have separate and independent axes to independently rotate about.

The dual structure according to this embodiment is described with reference to FIGS. 8 and 14. The tension bar makes contact with the guide rails 202, 205 with a ball bearing 803 interposed therebetween, and is thereby allowed to smoothly move upward and downward. The inner bar 801, i.e., pinion bar, rotates as moving upward or downward. The ball bearing 803 is held in contact with the inner bar 801, so that the ball bearing 803 absorbs the rotation of the inner bar 801 and the outer side of the ball bearing 803 rotates, like a wheel, on one of the guide rails 202, 205. This may allow the inner bar 801 to smoothly move on the guide rails 202, 205. A pinion 702 is smaller in diameter than the pinion bar 801, and part of a rack 703 supports a shoulder 807 of the pinion bar 801. This may prevent lateral displacement of the tension applying member.

In vicinity of both ends of the inner bar 801 are mounted a pinion gear 702 coaxial with the pinion bar 801. The pinion gear 702 is engaged with a rack gear 703 and rotates as the tension bar moves upward or downward. When one of the pinions at both ends of the inner bar 801 moves upward or downward, the moving pinion rotates, inviting the pinion on the opposite side of the inner bar 801 to rotate likewise. This may prevent the pinion gear 702 from moving against the engagement with the rack gear 703, avoiding inclination of the inner bar 801. The widths of the rack gear 703 and the pinion gear 702 (vertical lengths in FIG. 8) may be desirably greater. With greater widths of the rack gear 703 and the pinion gear 702, inclination of the inner bar 801 may be more effectively prevented (angle made by the inner bar 801 and the horizontal plane may be prevented from increasing).

In this embodiment, the inner bar 801 is supported by the rack gear 703 via the pinion gear 702 and the guide rails 202, 205 via the ball bearing 803. This may prevent movements of the tension bar in lateral directions illustrated in FIG. 8. In cases where the tension bar is supported by the engagement between the pinion gear 702 and the rack gear 703 alone, the rack may be subject to excessive load and thereby degraded in durability. This embodiment, by having the inner bar 801 supported by the rack gear 703 via the pinion gear 702 and the guide rails 202, 205 via the ball bearing 803, may avoid the risk of degrading the pinion gear 702 and the rack gear 703 in durability.

The pinion gear 702 and the rack gear 703 may be desirably made of metals. Examples of the metals used for the pinion gear 702 and the rack gear 703 may include stainless steels.

In this embodiment, the inner bar 801 is supported by the rack gear 703 and the guide rails 202, 205. This is a non-limiting example, and any suitable method known to the skilled in the art may be employed instead.

When the pinion 702 rotates as the tension bar moves upward and downward, the inner bar 801 connected coaxially to the pinion 702 rotates as well. As illustrated in FIG. 14, the inner bar 801 and the outer bar 704, which serves as a tension applying bar, are connected to each other with a ball bearing 1401 so as to freely rotate. When the pinion 702 rotates, the inner bar 801 correspondingly rotates, while the outer bar 704 remains unrotated.

Figure 8:
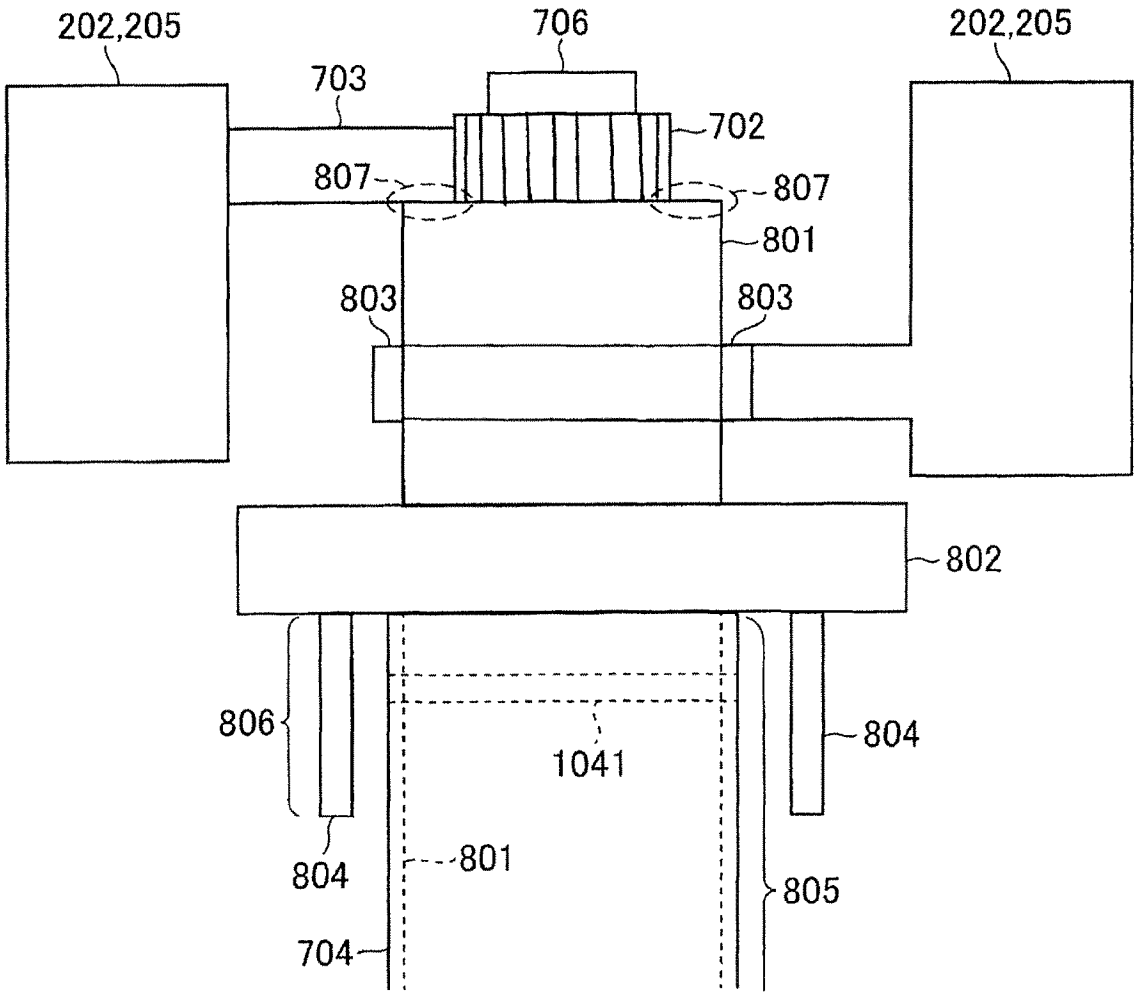
FIG. 8 is a schematic drawing of a relationship among the pinion of the tension bar, a rack, and weights according to the embodiment.
Figure 14:
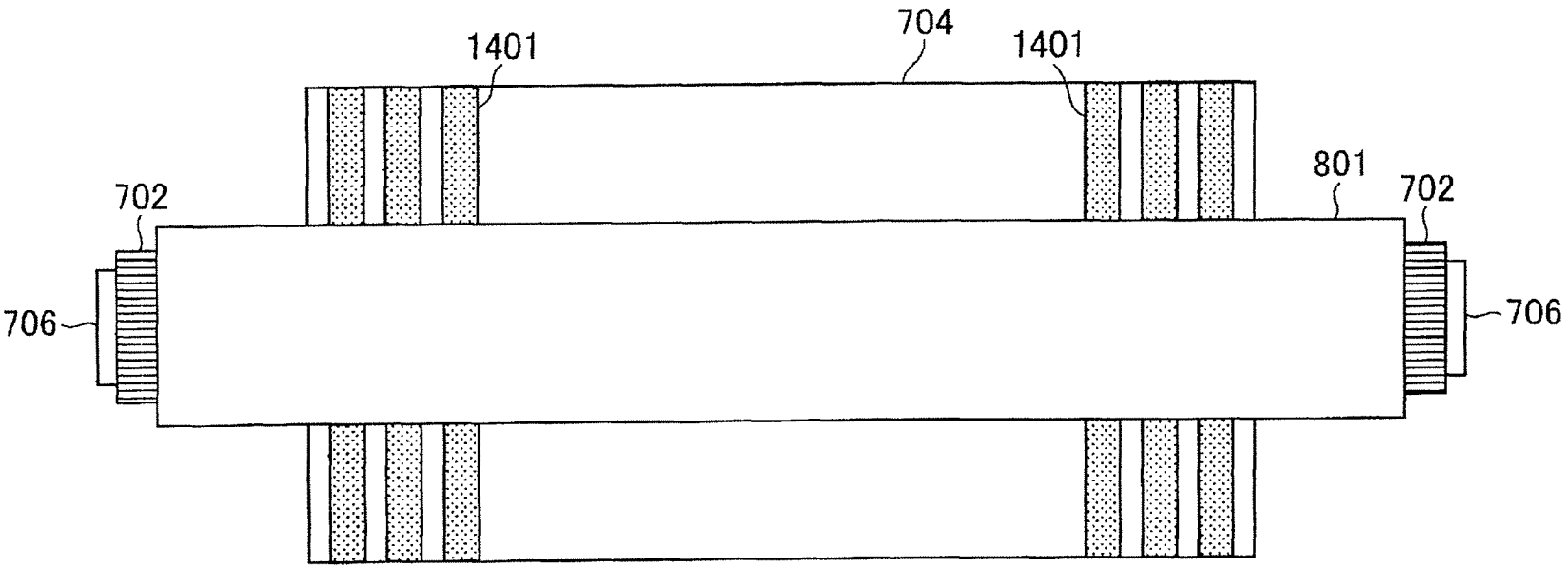
FIG. 14 is an explanatory drawing of the dual structure of the tension bar according to the embodiment.

In a dual-structured portion 805 of the tension bar illustrated in FIG. 8 which is structured as described so far, the inner bar 801 thinner than and coaxial with the outer bar 704 is fitted inside of the outer bar 704, as illustrated in FIG. 14.

In this structure, the tension bar is held in a horizontally balanced manner by the rack-pinion engaging mechanisms, and the outer bar 704 in contact with the print medium does not rotate in response to upward and downward movements of the tension bar. This structural feature may avoid that any unwanted tension is applied to the print medium by the rack-pinion engaging mechanisms, affording stable transport of the print medium. As a result, more accurate and reliable control of the tension applied to the print medium may be attainable, in addition to accurate position detection by the sensor unit described below according to this embodiment and appropriate tension control enabled by the accurate position detection.

A weight(s) is mountable to the tension bars serving as a tension applying member, according to this embodiment. The tension to be applied to the print medium may be adjusted with an additional weight(s), if necessary, in addition to the self weights of the tension bars. A required level of tension may differ depending on a print medium used and/or contents to be printed on the medium. In this embodiment, the platen has a mechanism equipped to suction the print medium under air pressure in order to stabilize the printing operation. Such a mechanism is likely to increase the tension to be applied, which needs to be adjusted suitably for a print medium used and/or contents to be printed on the print medium. This tension adjustment may require the use of a suction force and tension bars. The conventional tension adjustments may use weights that are hanged with ropes from ends of a tension bar, as stated earlier regarding a background art. However, this solution involving a number of unsolved issues is, in fact, almost impractical.

Figure 9:
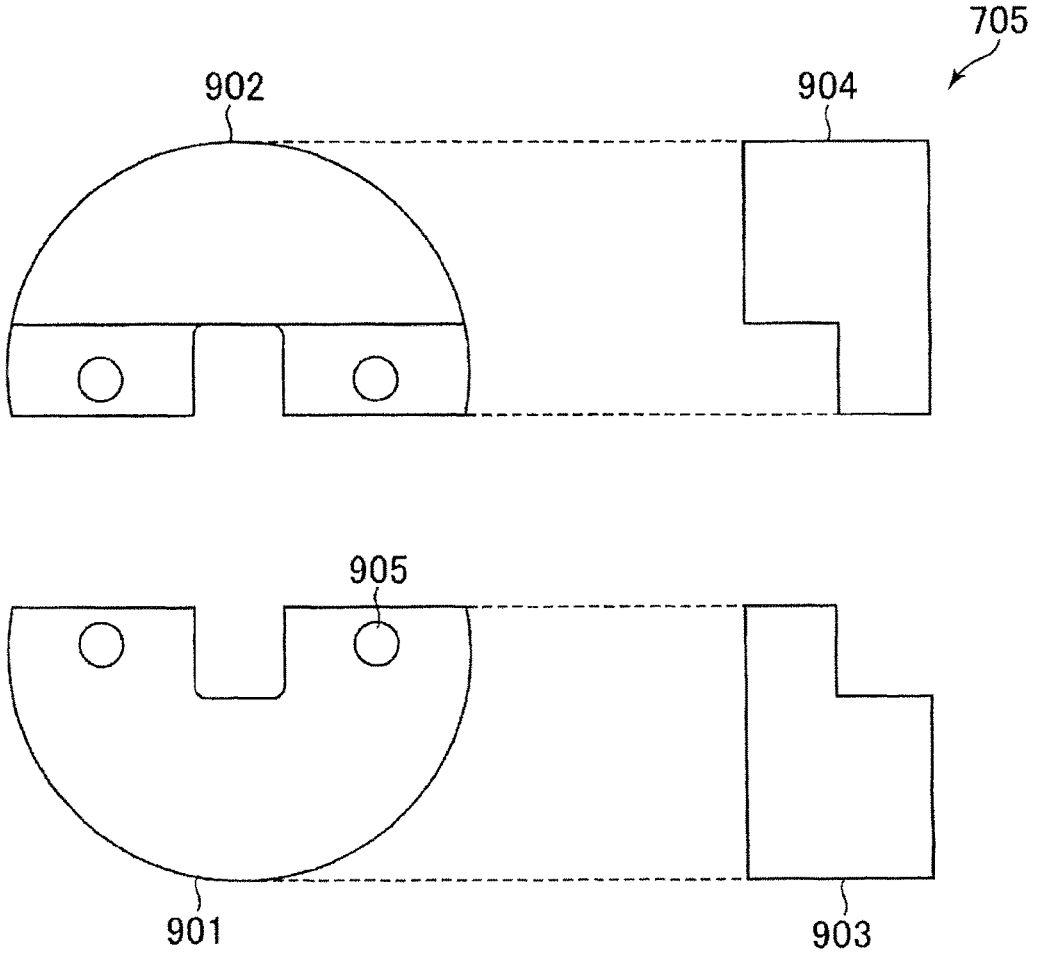
FIG. 9 is a structural drawing of weights of the tension bar according to the embodiment.
Figure 10:
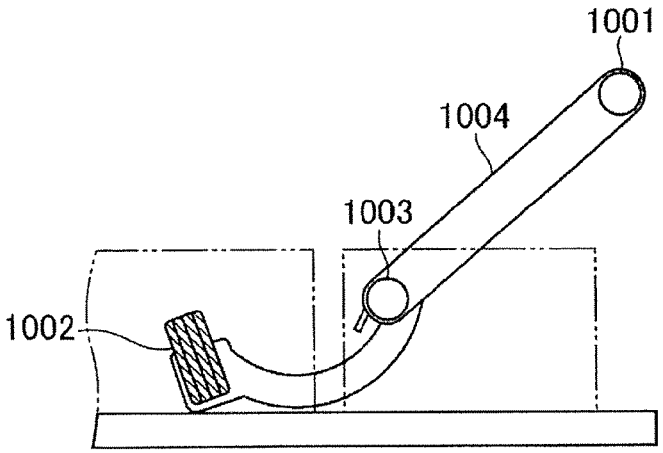
FIG. 10 is a drawing of a conventional tension bar.

This embodiment uses, instead of hanging weights as conventionally done, a hollow and columnar weight 705 mounted coaxially to the tension bar, as illustrated in FIG. 7. Specifically, two fitting rods 804 are attached to a dish-shaped weight fitting portion 802 mounted coaxially to the inner bar 801 as illustrated in FIG. 8. The fitting rods 804 are perpendicular to the surface of the weight fitting portion 802. The weight 705 is fitted to the fitting rods 804 and thereby fixed. As illustrated in FIG. 9, the weight 705 has holes 905 in its semi-circular plates 901 and 902. The holes 905 are formed to receive the fitting rods 804 inserted therein. The weight 705, once attached to the weight fitting portion 802, forms a hollow columnar shape. At the center part of the weight is formed a cavity greater than the outer diameter of the outer bar 704 so as to coaxially insert the outer bar 704 in the cavity with some space therebetween. As a result, the weight 705 does not contact the outer bar 704 and rotates with the inner bar 801. While this embodiment provides two fitting rods, the number of the fitting rods may be variously changed suitably for structural features including the tension bar.

The weight 705, when fixed to the tension bar, is held between and fixed by the semi-circular plates 901 and 902. As is known from transverse planes 903 and 904, the weight 705 has recesses that are formed to fix the weight 705, with the holes 905 and their vicinity overlapping each other. The weight thus structured may be readily mountable and removable without removing the tension bar. The weight may be fixable with a fixing tool not illustrated in the drawing according to any suitable method known to the skilled in the art.

Further, the weight is mountable to the dish-shaped weight fitting portion 802 with no contact between a center part of the weight and the outer bar 704. After the weight is fixed to the tension bar, the outer bar 704 coming in contact with the transported print medium may be subject to a rotational force generated by the contact. Yet, the rotational force is not conveyed to the weight 705 thus spaced at its center from the outer bar. Because the dish-shaped weight fitting portion 802 is attached to the inner bar 801, and the weight 705 is spaced from the outer bar 704, the mounted weight 705 may be unlikely to affect the moment of the outer bar 704.

Conventionally, the tension bar makes contact with the print medium that continues to be transported. The outer bar 704 of the tension bar is accordingly subject to a rotational force as the print medium is being printed and transported. The weight shaped as described in this embodiment, if mounted to the outer bar 704, may increase the moment of the outer bar 704. Then, a large moment of inertia may act on the print medium when the printing operation is stopped, possibly stretching the print medium. This is more likely with softer print media.

Regardless of whether the print medium is stretched, such a large moment of the outer bar 704, which rotates as the print medium is transported, is certainly not advisable in any transport mechanisms. In this embodiment, the weight 705 fixed to the inner bar 801 does not rotate with the outer bar 704, and damage to or unreliable transport of the print medium may be accordingly avoided. This embodiment, therefore, may afford flexible adjustments of the tension to be applied for print media used and/or contents to be printed on the print media.

[Position Detection According to this Embodiment]

Figure 12:
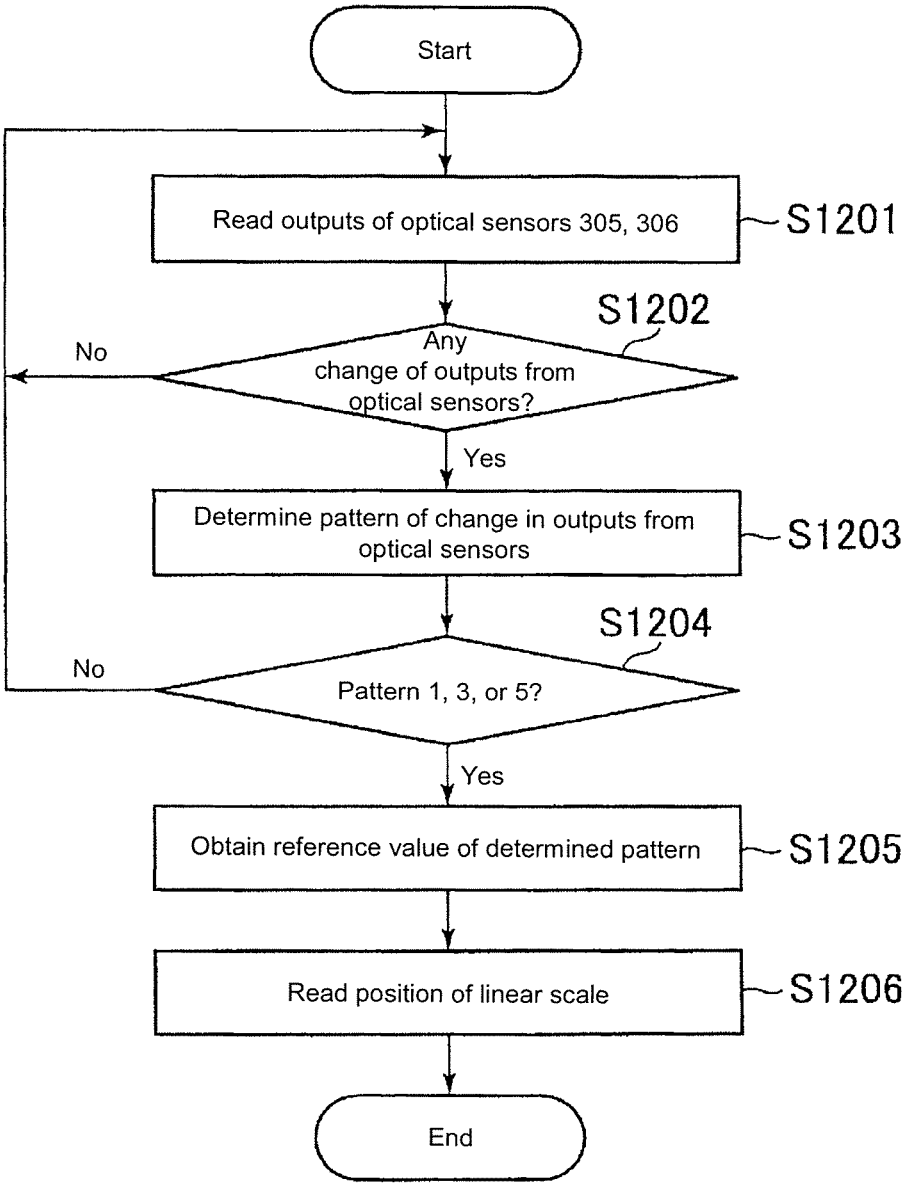
FIG. 12 is a flow chart of processing steps by optical sensors for detecting an absolute position according to the embodiment.
Figure 13:
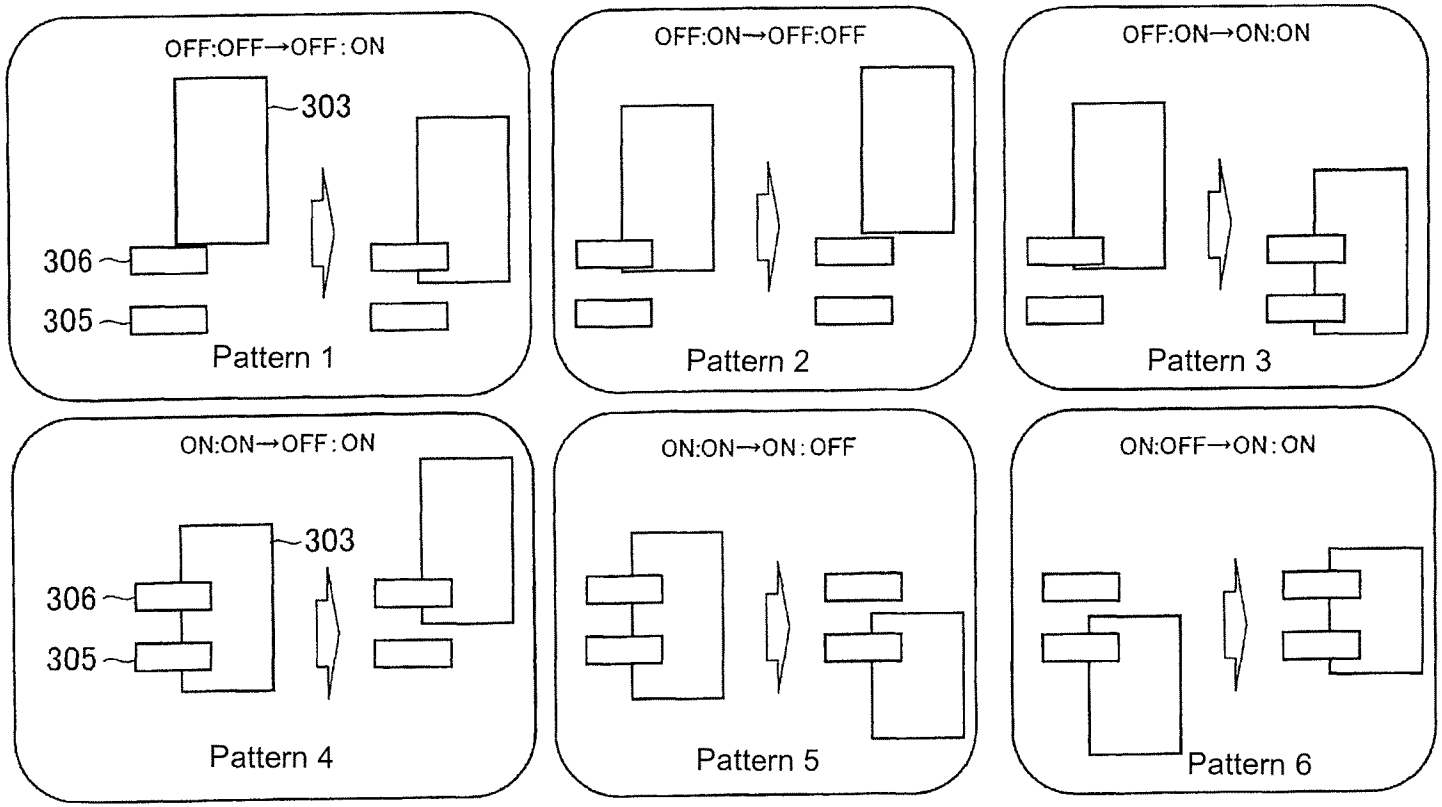
FIG. 13 is a schematic drawing of a relationship between the optical sensors and a driven-to-move plate according to the embodiment.

An absolute position detecting method for the tension bar using optical sensors 305 and 306 is described referring to FIGS. 12 and 13. Essentially, the position of the driven-to-move plate 303 is detected by using two optical sensors 305 and 306 as indicated by patterns illustrated in FIG. 13. A controller determines the position of the driven-to-move plate based on results of detection by two optical sensors (whether light emitted from the light-emitting element is blocked by the driven-to-move plate) to determine the position of the sensor head. There are four combinations of outputs from the two optical sensors 305 and 306, respectively; ON:ON, ON:OFF, OFF:ON, and OFF:OFF. In this embodiment, when one of the output combinations of the optical sensors changes to another in response to movement of the driven-to-move plate, the controller reads the changed pattern and determines a corresponding pattern of change.

The driven-to-move plate 303 moves, passing the optical sensors 305 and 306 vertically arranged, providing six patterns of change possible with the two optical sensors, as illustrated in FIG. 13. Normally, the tension bar is driven to move upward and downward within a predetermined range. Therefore, upper and lower limits 304 and 301 are similarly defined for the position of the sensor head that detects the position of the tension bar. In cases where the position of the sensor head goes beyond the range of the upper and lower limits 304 and 301 during the normal printing operation, the sensor head is controlled to return to this range. In cases where the position of the sensor head, once departed from the range of the upper and lower limits 304 and 301, fails to return to this range within a given period of time, an error message or a warning may be displayed to suggest a poor print result, or the printing operation may be stopped.

During initialization or removal of the feed roller to replace the print medium, the position of the sensor head is outside of this range. It is necessary for measurements using the linear encoder to detect upper-limit and lower-limit positions and initialize the linear encoder. Below is described a method of determining upper-limit and lower-limit positions using the optical sensors 305 and 306. This embodiment initializes the linear encoder using the optical sensors 305 and 306 and then uses values measured on the linear scale. Instead, an absolute linear encoder may be used, in which case the position control may be possible with the linear encoder alone.

The six patterns of change illustrated in FIG. 13 are possible as combinations of outputs from the optical sensors. In this embodiment, of the six patterns, positions of the patterns of change 1, 3, and 5 when the driven-to-move plate moves downward as required by the printer are used as reference values of the absolute position. Instead, all of the six patterns may be used, or reference values may be obtained from other combinations of the patterns and used.

Specifically, reference values may be calculated beforehand based on the size and original position of the driven-to-move plate and original positions of the optical sensors in order to obtain the absolute position of the sensor head for each pattern of change. The current position of the sensor head may be calculated from one of the patterns detected based on the reference values. Then, the position of the tension bar may be accurately obtained from the linear scale based on the calculated current position. For instance, the reference value with the pattern 1 is a1, the reference value with the pattern 3 is a3, and the reference value with the pattern 5 is a5. The reference value means the count of the linear encoder when the position of the tension bar is elevated from positions of the patterns of change 1, 3, and 5 to a predetermined position. The predetermined position of the tension bar means, for example, a position at which a desired tension is applicable by the tension bar to the print medium.

For instance, L is the relative value measured by the linear encoder after the pattern 1, 3, 5 is detected. Then, the position of the tension bar may be controlled so that the value L is a1 based on the count of the linear encoder, unless any change has occurred in the result detected by the optical sensors since the pattern of change 1. In this manner, the tension bar may be held at a desired position. By thus determining the pattern of change using the optical sensors, the reference value may be quickly obtainable, reducing initializing and setting time frames. As an alternative, an offset value may be added to the value L to obtain the absolute value of the tension bar and used for control.

A position-detect pattern determining method for the driven-to-move plate is hereinafter described. As illustrated in the flow chart of FIG. 12, the controller reads a combination of outputs from the optical sensors 305 and 306 (S1201), and monitors whether any change has occurred in the combination of outputs from the optical sensors 305 and 306 (S1202).

In cases where the combination of outputs from the optical sensors 305 and 306 has changed as a result of position change of the tension bar and corresponding movement of the driven-to-move plate 303 (YES in S1202), the controller determines how the combination of outputs from the optical sensors 305 and 306 has changed (S1204). In cases of the pattern 1, 3, or 5 (YES in S1204) as illustrated in FIG. 13, the controller, in this embodiment, obtains the reference value of the pattern 1, 3, or 5 among the possible six patterns of change (S1205). The reference value for control of the height of the tension bar using the linear scale may be a value indicative of a desired tension applicable by the tension bar to the print medium. In FIG. 13, the reference value is indicative of a position at which a vertically center position of the driven-to-move plate 303 coincides with a vertical center between the optical sensors 305 and 306.

As described, the reference value mostly differs according to the pattern 1, 3, or 5. The reference values obtained in advance based on the printer's configuration may be stored in, for example, a memory, so that the reference value of any pattern determined later is read and used. This is, however, a non-limiting example.

The controller sets a preset value as the reference value for control of the tension bar's height using the linear scale (S1205), and selects the linear encoder for control of the tension bar's height, in place of the currently set optical sensors 305 and 306. After the linear encoder is selected and set for control of the tension bar's height, the controller reads the linear scale and accordingly adjusts the position of the tension bar to a predetermined position (S1205).

The outputs of the optical sensors 305 and 306 may be used for error detection or other purposes after the linear encoder is selected for control of the tension bar's height in place of the optical sensors 305 and 306. In cases of no change in the combination of outputs from the optical sensors 305 and 306 within a given period of time after the pattern of change 2 illustrated in FIG. 13 is detected, the event of an abnormality may be confirmed. In that case, the position of the tension bar is situated more upward than the predetermined range, failing to return to the predetermined range within a given period of time.

The printer and the transport apparatus according to this embodiment thus characterized may prevent the rotation of the tension bar from transmitting to the print medium, thereby affording stable transport of the print medium. Further advantageously, the printer and the transport apparatus may ensure accurate tension control, thereby allowing a stable tension to be applied.

Second Embodiment

This embodiment is similar to the first embodiment except specific features in the dual structure of the tension applying member. The tension applying member according to this embodiment includes outer and inner bars. This embodiment is different in that the tension applying member has two unconnected and separate inner bars on both sides, as illustrated in FIG. 15, unlike earlier embodiment that provides a single inner bar at the center.

Figure 15:
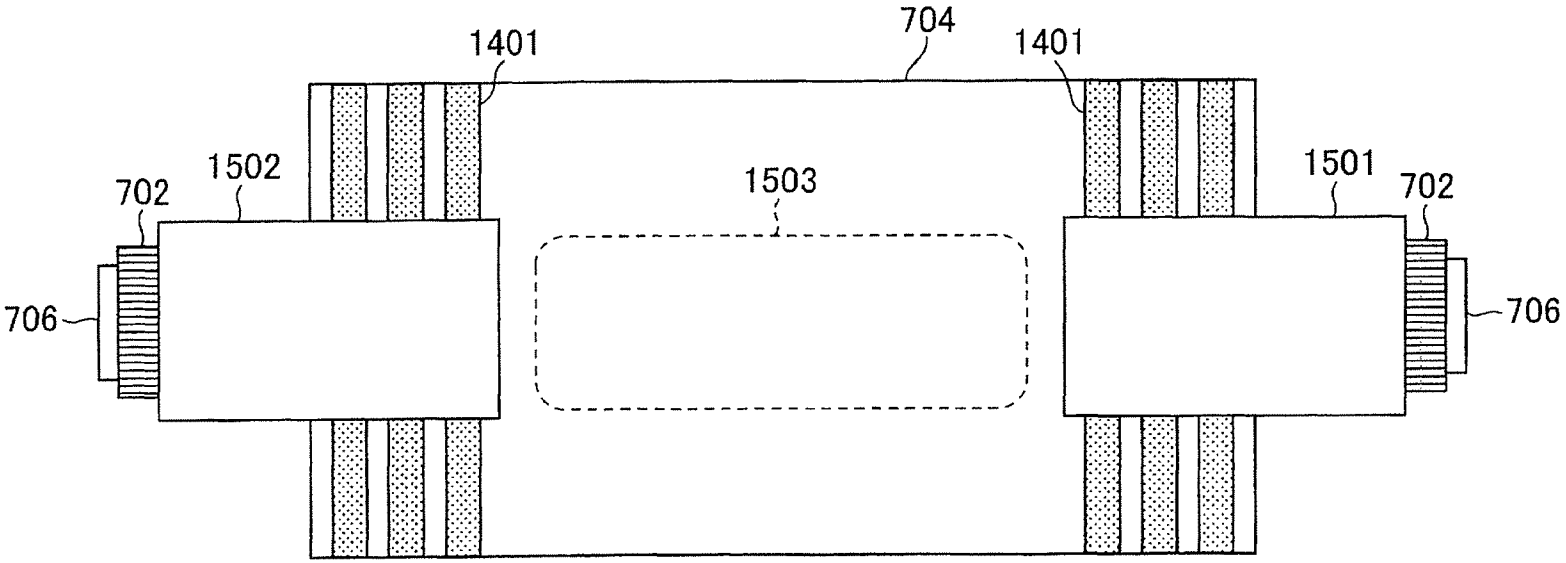
FIG. 15 is an explanatory drawing of the dual structure of another tension bar according to the embodiment.
Figure 16:
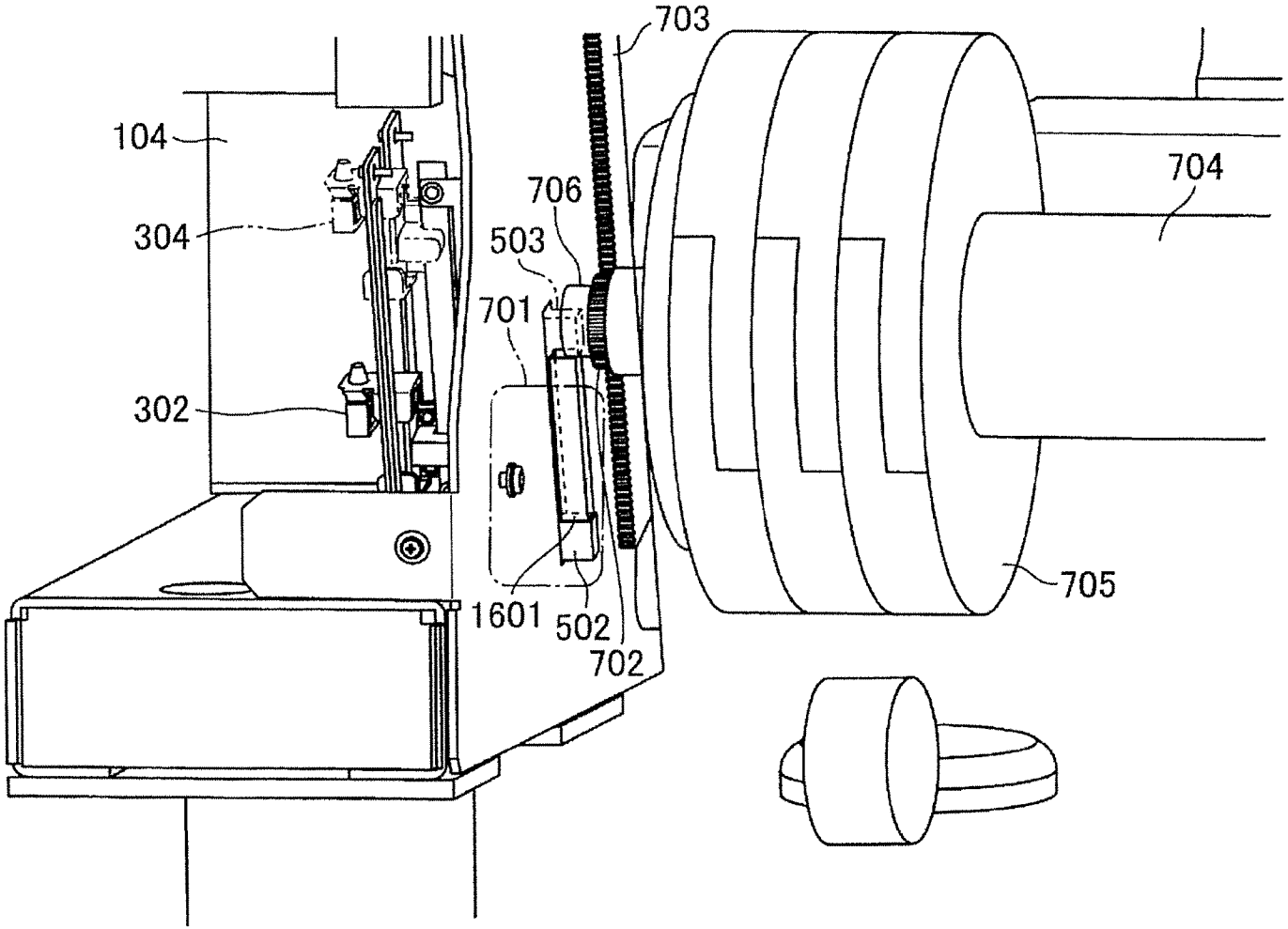
FIG. 16 is an enlarged view of a sensor unit and the pinion of a tension bar according to another embodiment of this disclosure.

With reference to FIG. 15, inner bars 1501 and 1502 according to this embodiment have pinions 702 in vicinity of their ends. The pinions are rotatably and coaxially attached to the outer bar 704 with ball bearings 1401. Unlike the first embodiment that provides the inner bar 801 in an inner part 1503 at the center of the outer bar 704, two shorter inner bars 1501 and 1502 to which pinions are attached are connected to the ball bearings 1401. This structural feature may reduce the weight of the tension applying member and also reduce manufacturing costs by using shorter inner bars more easily attachable.

Because the two inner bars 1501 and 1502 are not connected to each other, with the pinions on their both sides being allowed to freely rotate, horizontal inclination may be more likely than the first embodiment. Yet, horizontal balance may be attained to a certain extent by increasing pinion gears in width. With greater widths of the rack gear 703 and the pinion gear 702, the inner bar 1501, 1502 is less likely to incline, preventing increase of an angle made by the inner bar 1501, 1502 and the horizontal plane.

In this embodiment, the pinion gears 702 at both ends of the two inner bars 1501 and 1502 are not particularly necessary. With the pinion gear 702 disposed at either end of the inner bar 1501, 1502, inclination of the tension bar may be prevented by the rack gear 703 and the pinion gear 702. Thus, the pinion gear 702 at either end of the inner bar 1501, 1502 may help the tension bar to keep a horizontally balanced position to a certain degree.

This embodiment thus characterized may reduce the weight of the tension applying member and also reduce manufacturing costs by using shorter inner bars more easily attachable.

Third Embodiment

This embodiment is basically similar to the first embodiment except that the tension bar is used outside of the normal range. While the tension bar is accurately controlled to stay within a certain range by using the sensors as described in the first embodiment, it may be desirable with some print media and/or print contents to control the tension bar at positions outside of the normal range. Possible creasing of the print medium may be more effectively prevented by, for example, adjustments to reduce lengths of the print medium between the pinch roller 1102/grid roller 208 and the tension bar and between the pull roller 206 and the tension bar.

The sensor for detecting the tension bar's position needs to be located suitably for the position of the tension bar so as to detect movement of the tension bar. In cases where the moving range of the tension bar goes beyond the range of the upper and lower limits 304 and 301 that is the moving range of the sensor head 302, a mechanism may be additionally necessary that changes the vertical position of the sensor unit 104. Such a position changing mechanism rather complicated, if used instead of the fixed sensor unit 104, may be a factor of cost increase. This embodiment, therefore, seeks to facilitate change of the position-detection range of the tension bar by using simple parts easily attachable.

With reference to FIG. 7, the claw 502 according to the first embodiment "directly" contacts the lower side of the end 706 of the tension bar. In this structure, the position of the claw 503 is the upper limit within which the tension bar's position is detectable by the sensor head 302, while the position detection is not possible beyond this limit. This structure, therefore, fails to deal with any case in which the tension bar's position is desirably controlled at upper positions than usual printing positions.

As a solution, this embodiment provides a position-adjusting mechanism 1601 on the vertically upper side of the claw 502. By having the lower end of the position-adjusting mechanism 1601 contact the claw 502 and having the upper end of the position-adjusting mechanism 1601 contact the lower end 706 of the tension bar, the range of positions of the tension bar detectable by the sensors may be easily changed. The position-adjusting mechanism 1601 may be a component in the form of a rod.

The position-adjusting mechanism 1601 in this embodiment may serve to change lengths of the print medium between the pinch roller 1102/grid roller 208 and the tension bar and between the pull roller 206 and the tension bar. A complicated mechanism may be unnecessary to change the vertical position of the sensor unit 104. The position-adjusting mechanism 1601 may be as effective as such a complicated mechanism to change the vertical position of the sensor unit 104.

According to this embodiment thus providing the effective structural features, the moving range of the tension bar may be changed suitably for different types of print media.

The embodiments thus far described are non-limiting examples of this disclosure. The embodiments described in this disclosure may be carried out in various forms. Some of the technical features described herein may be omitted, or replaced or combined with other features within the scope and spirit of this disclosure. For example, the tension applying member according to this embodiment is not solely for use in the printer described in this disclosure but is applicable to printers in general configured to carry out printing on print media while transporting them. The sensor unit described in the embodiments is not solely for use in the detection of the tension bar's position but is applicable to transport mechanisms configured to move within a certain range and operate to linearly detect an accurate position.

What is claimed is:

1. A printer configured to carry out printing on a medium unwound from a feed roller and collect the medium using a take-up roller, the printer comprising:

a transport unit that transports the medium in a predetermined transport direction, the transport unit being disposed on a transport path between the feed roller and the take-up roller;

a tension applying member disposed on the transport path between the feed roller and the take-up roller, the tension applying member comprising a tension applying bar having a tubular shape and a pinion bar having a pinion at an end of the pinion bar in a direction in which the tension applying bar is extending, the tension applying bar extending in a direction intersecting with the transport direction of the medium and applying a tension to the medium by coming in contact with the medium, the pinion bar being a shaft disposed inside of the tubular shape of the tension applying bar and parallel to the direction in which the tension applying bar is extending, the pinion bar supporting the tension applying bar so as to allow for a relative rotation that the tension applying bar and the pinion bar are configured to be rotatable relative to each other; and a support unit having a guiding unit that guides the tension applying member in a moving direction of the tension applying member and further having a rack engageable with the pinion of the pinion bar to allow for movement of the tension applying member while the pinion bar is rotating, wherein the tension applying member applies a certain degree of tension to the medium by moving the guiding unit.

2. The printer according to claim 1, wherein the pinion bar comprises a weight holder that holds a weight for adjustment of the tension applied by the tension applying member.

3. The printer according to claim 2, wherein the weight holder is disposed at both ends of the pinion bar, the weight is a hollow column or a hollow disc coaxial with the pinion bar, and a hollow portion of the hollow column or the hollow disc is greater in diameter than the tension applying bar.

4. The printer according to claim 3, wherein the support unit comprises a tension applying member fixture in an upper part of the support unit.

5. A transport apparatus configured to collect a medium unwound from a feed roller using a take-up roller, the transport apparatus comprising:

a transport unit that transports the medium in a predetermined transport direction;

a tension applying member having pinions at both ends of the tension applying member and disposed between the feed roller or the take-up roller and the transport unit, the tension applying member applying a tension to the medium by coming in contact with the medium, wherein the tension applying member comprising a tension applying bar having a tubular shape and a pinion bar having a pinion at an end of the pinion bar in a direction in which the tension applying bar is extending, the tension applying bar extending in a direction intersecting with the transport direction of the medium and applying a tension to the medium by coming in contact with the medium, the pinion bar being a shaft disposed inside of the tubular shape of the tension applying bar and parallel to the direction in which the tension applying bar is extending, the pinion bar supporting the tension applying bar so as to allow for a relative rotation that the tension applying bar and the pinion bar are configured to be rotatable relative to each other;

a support unit that supports the tension applying member, the support unit having a rack engageable with the pinion of the pinion bar;

a position detector comprising a detection head that moves with the tension applying member, the detection head comprising a driven-to-move plate to define a moving range of the tension applying member, the position detector further comprising a linear scale with a scale read by the detection head; and a moving range determining unit which has two sensors that detect the presence/absence of the driven-to-move plate and which detects whether the tension applying member is within the moving range based on patterns detected by the two sensors.

* * * * *